US007618218B2

(12) United States Patent
Newman

(10) Patent No.: US 7,618,218 B2
(45) Date of Patent: Nov. 17, 2009

(54) INTERLOCKING RETAINER TIES

(76) Inventor: James Gray Newman, 3663 N. Lamar Rd., Mt. Juliet, TN (US) 37122

( * ) Notice: Subject to any disclaimer, the term of this patent is extended or adjusted under 35 U.S.C. 154(b) by 245 days.

(21) Appl. No.: 11/695,490

(22) Filed: Apr. 2, 2007

(65) Prior Publication Data

US 2008/0240867 A1 Oct. 2, 2008

(51) Int. Cl.
*E02D 5/20* (2006.01)

(52) U.S. Cl. ..... 405/284; 52/166

(58) Field of Classification Search ..... 405/284–286; 52/166

See application file for complete search history.

(56) References Cited

U.S. PATENT DOCUMENTS

| | | | | |
|---|---|---|---|---|
| 1,733,790 | A | 10/1929 | Gilman | |
| 1,907,053 | A * | 5/1933 | Flath | 405/273 |
| 2,123,016 | A * | 7/1938 | McDaniel | 405/273 |
| 2,313,363 | A | 3/1943 | Schmitt | |
| 4,278,364 | A | 7/1981 | Frehner | |
| 4,490,075 | A | 12/1984 | Risi et al. | |
| 4,787,185 | A * | 11/1988 | Gascho | 52/233 |
| 4,815,897 | A * | 3/1989 | Risi et al. | 405/284 |
| 5,205,675 | A | 4/1993 | Hamel | |
| 5,688,078 | A | 11/1997 | Hammer | |
| 6,616,382 | B2 | 9/2003 | Woolford et al. | |
| 7,059,808 | B2 | 6/2006 | Risi | |

* cited by examiner

*Primary Examiner*—John Kreck
(74) *Attorney, Agent, or Firm*—James Addison Barry, Jr.

(57) ABSTRACT

A retainer tie system 10 and method including a wall tie 120 having on the lower side 126 of the wall tie 120 triangular-shaped grooves 140, and a lip 150; a block tie 220 including a first and a second ridge 240, 242 on the upper side 224 of the block tie 220 such that the block tie 220 may fit across a deadman tie 320; and the deadman tie 320 including triangular-shaped tongues 340 on the upper side 120 of the deadman tie 320 for assembling a straight, concave, or convex interlocking retainer wall; and a forward and an aft ridge 350, 352 disposed on the upper side 324 of the deadman tie 320 for interlocking the deadman tie 320 with the block tie 220.

16 Claims, 10 Drawing Sheets

INTERLOCKING RETAINER TIES

FIELD OF INVENTION

The present invention relates to interlocking retainer ties and, more specifically, to interlocking retainer ties which can be used for construction of retainer walls.

BACKGROUND OF INVENTION

There is a need for retainer ties for construction of retainer walls such that the ties are large enough to be used with light equipment without the intensity of many man-hours of hand stacking numerous small blocks for building retainer walls. It would also be desirable for the ties to be interlocking with the capability for assembling straight, concave, and convex walls with different types of corners for different requirements. It would further be desirable to have locking ties that will anchor and give stability to the retainer wall without the use of geosynthetic reinforced methods.

SUMMARY

In general, in a first aspect, the invention features a retainer tie system and method is described that includes a wall tie having on the lower side of the wall tie triangular-shaped grooves, and a lip; a block tie including a first and a second ridge on the upper side of the block tie such that the block tie may fit across a deadman tie; and the deadman tie including triangular-shaped tongues on the upper side of the deadman tie for assembling a straight, concave, or convex interlocking retainer wall; and a forward and an aft ridge disposed on the upper side of the deadman tie for interlocking the deadman tie with the block tie. Embodiments of the invention may include one or more of the following features: Interlocking stairs; straight, concave, or convex interlocking retainer walls; ninety or forty-five degree turns or corners in the retainer wall, and variable lengths for multiple applications of retainer walls using interlocking ties.

BRIEF DESCRIPTION OF THE DRAWINGS

The features, aspects, and advantages of the invention will become better understood with regard to the following description, appended claims, and accompanying drawings where:

DETAILED DESCRIPTION OF THE INVENTION

The present invention relates to the field of retainer walls and more specifically interlocking ties, and provides an interlocking tie means for construction of retainer walls. In addition, this invention provides an apparatus and a method for constructing a retainer wall with interlocking ties. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

Figure 4A:
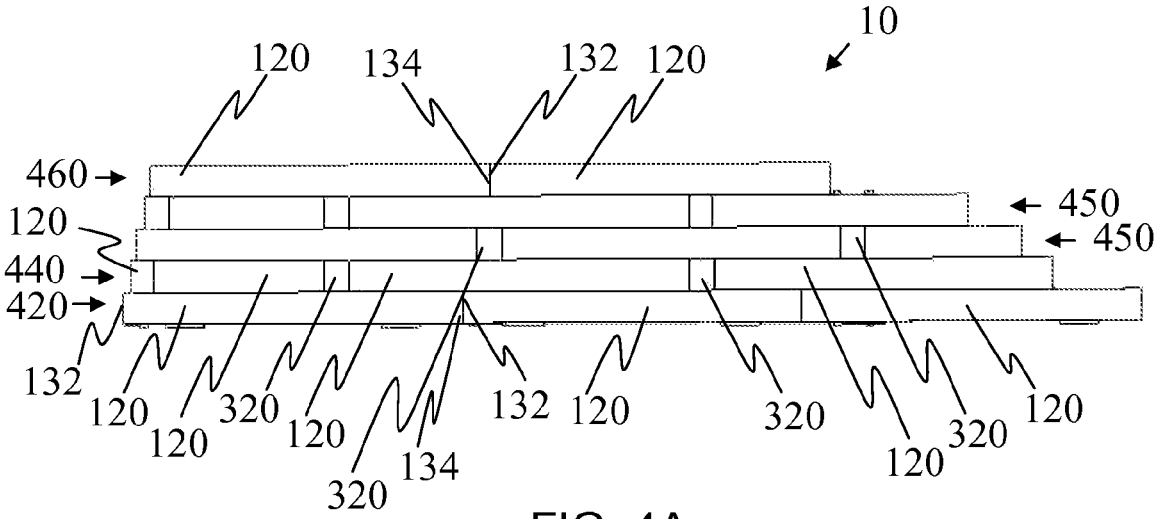
FIG. 4A is a front view of one embodiment of the retainer tie system according to the present invention.
Figure 4B:
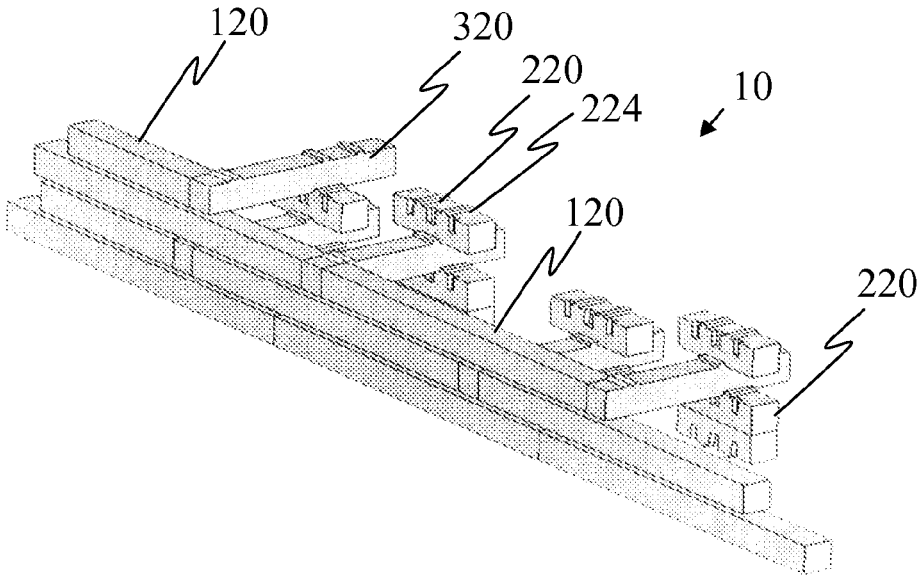
FIG. 4B is a perspective view of a partial assembly of an embodiment of the retainer tie system according to the present invention.
Figure 4C:
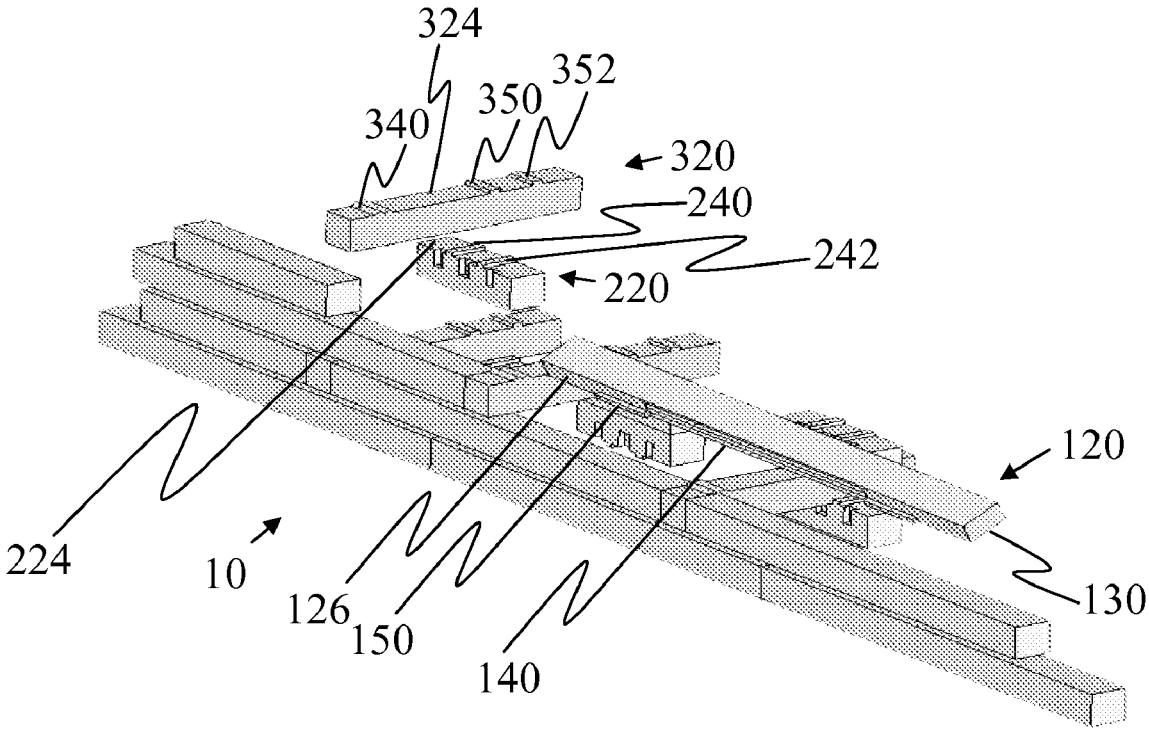
FIG. 4C is a perspective view depicting one partial assembly of one embodiment of the retainer tie system according to the present invention.
Figure 4D:
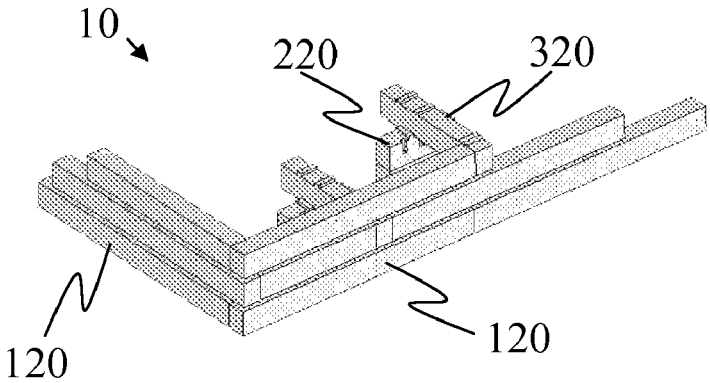
FIG. 4D is a top view depicting ninety degree corners of one embodiment of the retainer tie system according to the present invention.
Figure 4E:
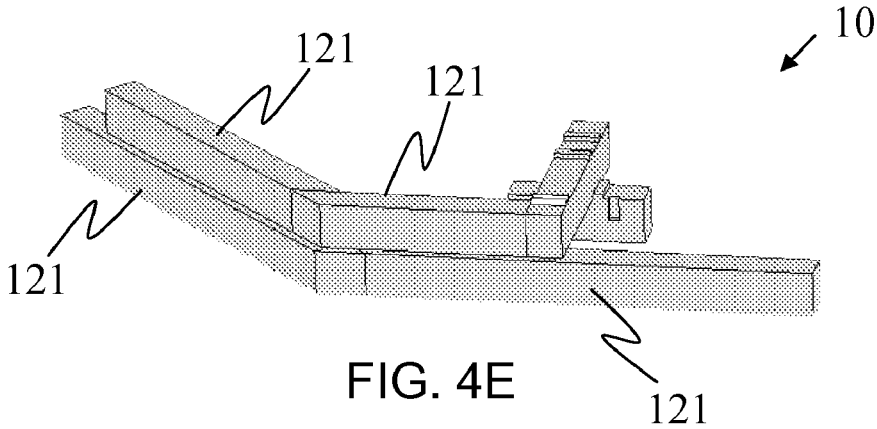
FIG. 4E is a top view depicting forty-five degree corners of one embodiment of the retainer tie system according to the present invention.

Overview:

A retainer tie system and method of assembling a retainer ties wall as shown in FIG. 4C including a wall tie 120 including on the lower side 126 of the wall tie 120 triangular-shaped grooves 140, and a lip 150; a block tie 220 including a pair of ridges 240, 242 spaced apart on the upper side 224 of the block tie 220 such that the block tie 220 may fit securely across a deadman tie 320; and the deadman tie 320 including two substantially triangular-shaped tongue 340 on the upper side 324 of the deadman tie 320; and a pair of ridges 350, 352 disposed on the upper side 324 of the deadman tie 320. Some embodiments of the retainer tie system and method of assembly are further depicted in FIGS. 4, 5, 6, and 7 showing a straight FIG. 5B, concave FIG. 6B, or convex FIG. 7B interlocking retainer wall. FIG. 4A depicts an assembled interlocking retainer wall while FIG. 4D illustrates ninety degree corners with the retainer wall and FIG. 4E illustrates forty-five degree corners.

Figure 1A:
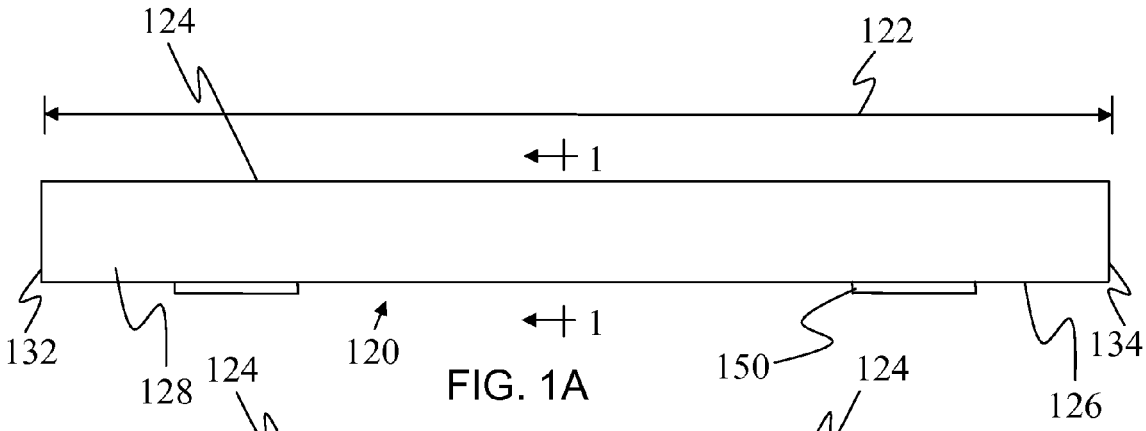
FIG. 1A is a front view of one embodiment of the wall tie according to the present invention.
Figure 1B:
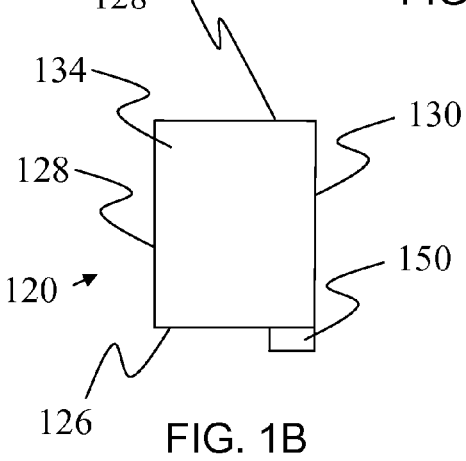
FIG. 1B is an end view of one embodiment of the wall tie according to the present invention.
Figure 1C:
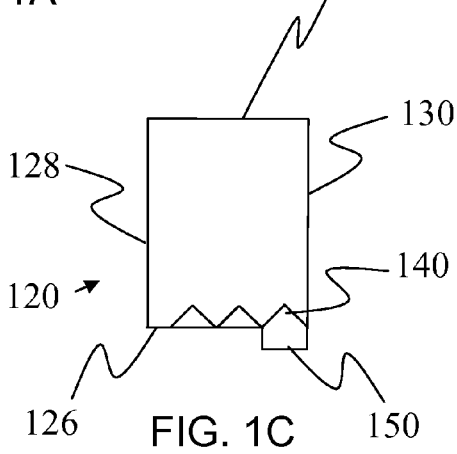
FIG. 1C is a cross section through the wall tie shown in FIG. 1A along the line 1-1.
Figure 1D:
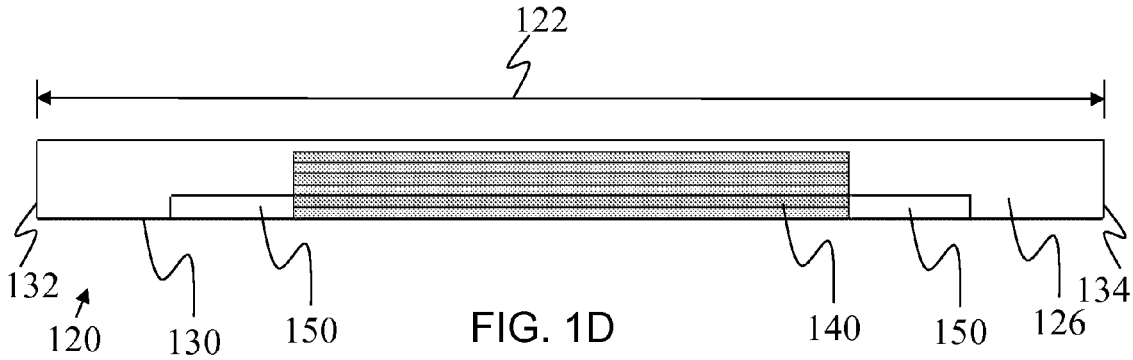
FIG. 1D is a lower view of one embodiment of the wall tie according to the present invention.
Figure 1E:
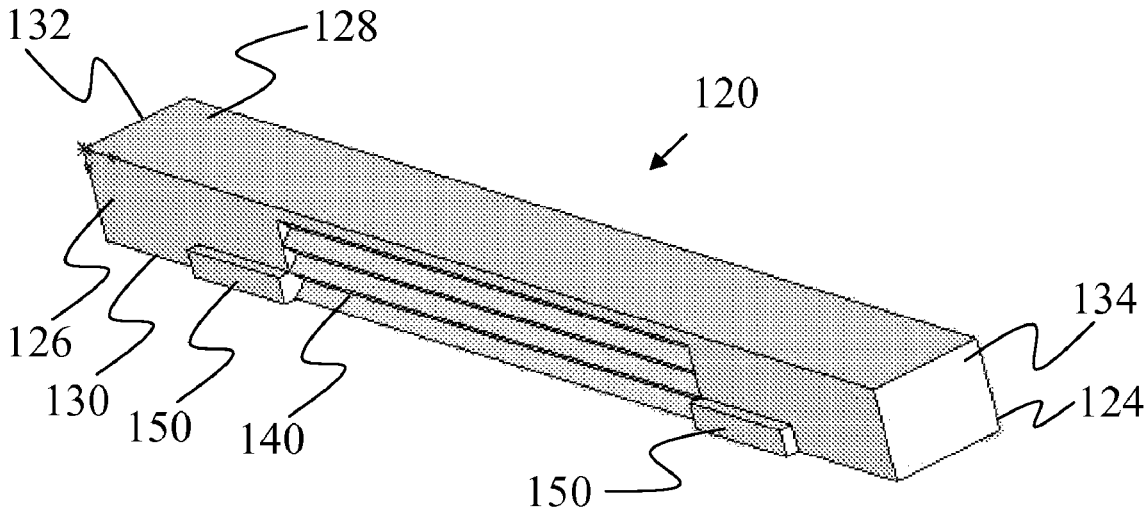
FIG. 1E is a perspective view of one embodiment of the wall tie according to the present invention.
Figure 1F:
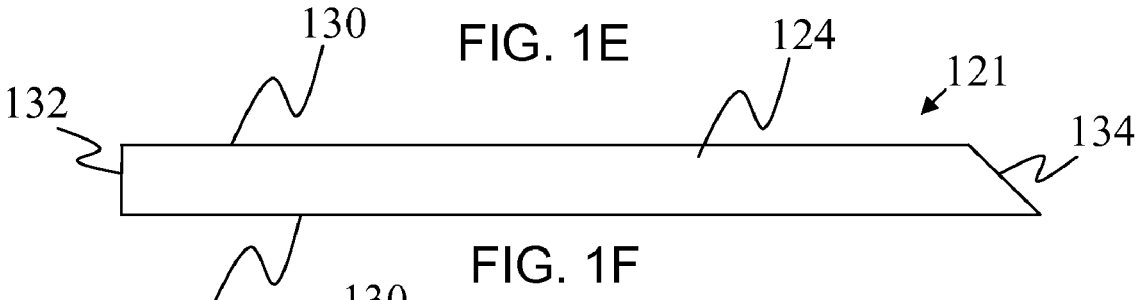
FIG. 1F is an upper view of one embodiment of the wall tie according to the present invention.
Figure 1G:
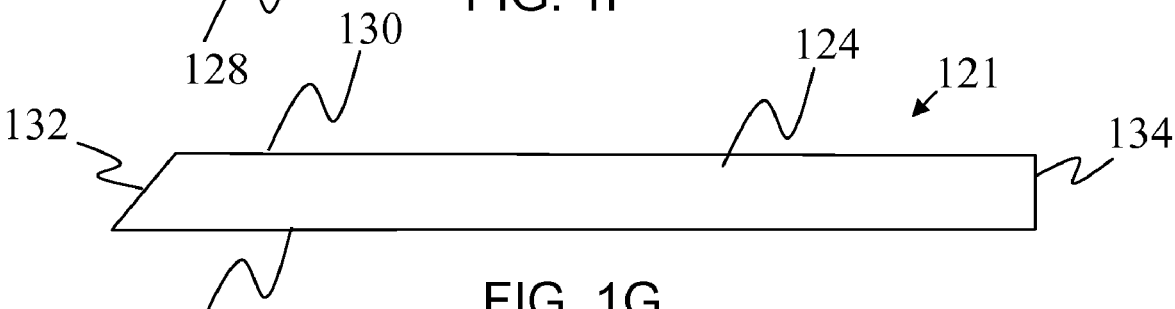
FIG. 1G is an upper view of another embodiment of the wall tie according to the present invention.
Figure 1H:
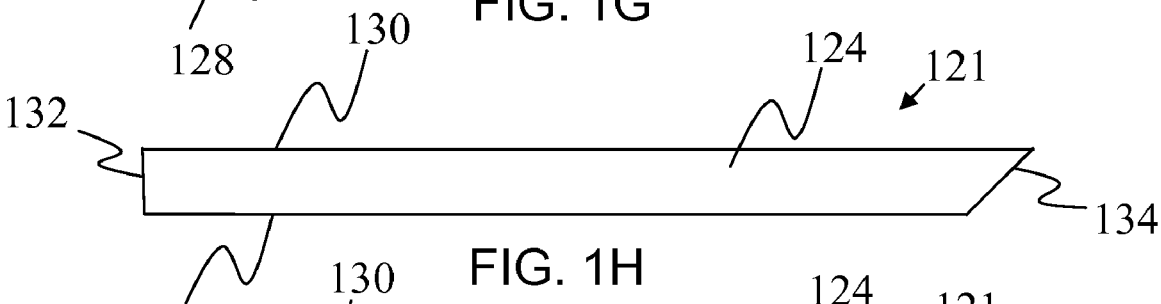
FIG. 1H is a perspective view of yet another embodiment of the wall tie according to the present invention.
Figure 1I:
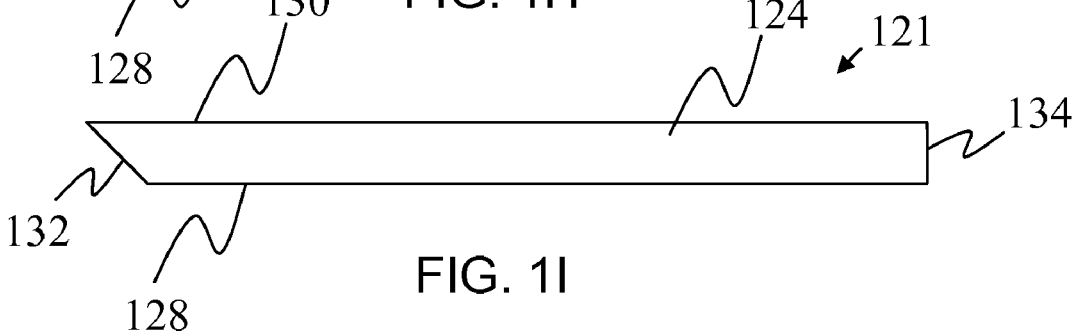
FIG. 1I is a perspective view of still another embodiment of the wall tie according to the present invention.

Design Specifications:

As depicted in different embodiments in FIGS. 1A through 1I, the wall tie 120 includes a length 122 having a substantially rectangular lateral cross-section as may be noted in FIG. 1C. In one embodiment, the wall tie 120 substantially rectangular lateral cross-section dimensions may be nine inches high by seven inches wide and the wall tie 120 length 122 may have a length dimension of four feet, six feet, or eight feet. The length dimension may be shortened as needed for the specific retainer wall size. The wall tie 120 surfaces are designated as an upper side 124, a lower side 126, a front side 128, a rear side 130, a first end 132, and a second end 134. The wall tie 120 further includes three adjoining substantially triangular-shaped grooves 140 that extend from a middle or midpoint of the lower side 126 of the wall tie 120 parallel with the longitudinal axis of the wall tie 120 toward the first end 132 and the second end 134 of the wall tie 120. The three adjoining substantially triangular-shaped grooves 140 are disposed on the lower side 126 of the wall tie 120 with the triangular-shaped grooves 140 adjoining and with the rearward triangular-shaped groove adjoining the intersection of the wall tie 120 rear side 130 and of the wall tie 120 lower side 126. The length of the grooves 140 may be dependent upon the length 122 of the wall tie 120. Typically, the length of the grooves 140 is approximately half the length 122 of the wall tie 120. One embodiment may include a wall tie 120 length 122 of ninety-six inches with the triangular-shaped grooves 140 length approximately fifty inches. Another embodiment may include the wall tie 120 length 122 of four feet with the triangular-shaped groove 140 length of two feet. The substantially triangular-shaped grooves 140 of the wall tie 120 may combine with substantially triangular-shaped tongue of the deadman tie to aid in interlocking the wall ties 120 with deadman ties for retainer wall stability. In addition, the three substantially triangular-shaped grooves 140 allow for the construction of a straight wall, a concave wall, or a convex wall. The wall tie 120 also includes a lip 150 on the lower side 126 of the wall tie 120 that may be a substantially rectangular-shape. The lip 150 is disposed where the rear side 130 and the lower side 126 adjoin such that the lip 150 begins where the wall tie 120 substantially triangular-shaped grooves 140 end and extend away from the substantially triangular-shaped grooves 140 toward the first or second end 132, 134 of the wall tie 120. The lip 150 may extend down about one inch vertically from the lower side 126 of the wall tie 120 and may extend forward horizontally about two inches from the rear side 130 of the wall tie 120 lower side 126. Typically the lip 150 extends from the end of the substantially triangular-shaped grooves 140 approximately half the distance from the triangular-shaped grooves 140 to the closest end of the wall tie 120. One embodiment with a wall tie 120 length 122 of ninety-six inches may include a lip 150 length of approximately six to eighteen inches while another embodiment with the same wall tie 120 length 122 may have a lip 150 length of eleven inches. The wall tie 120 may have a custom finish on the front side 128, an upper side 124, or either a first end 132 or a second end 134 or any combinations of these sides of the wall tie 120. An example of the custom finish may include but is not limited to a pea gravel finish or a natural limestone type finish. In addition, a wall tie with a forty-five degree angle 121 may have either a first end 132 or a second end 134 that has an approximately forty-five degree angle slope from the front side 128 to the rear side 130 or the rear side 130 to the front side 128 as illustrated in FIGS. 1F through 1I. This allows for construction of a retainer wall with a forty-five degree corner as depicted in FIG. 4E.

Figure 2A:
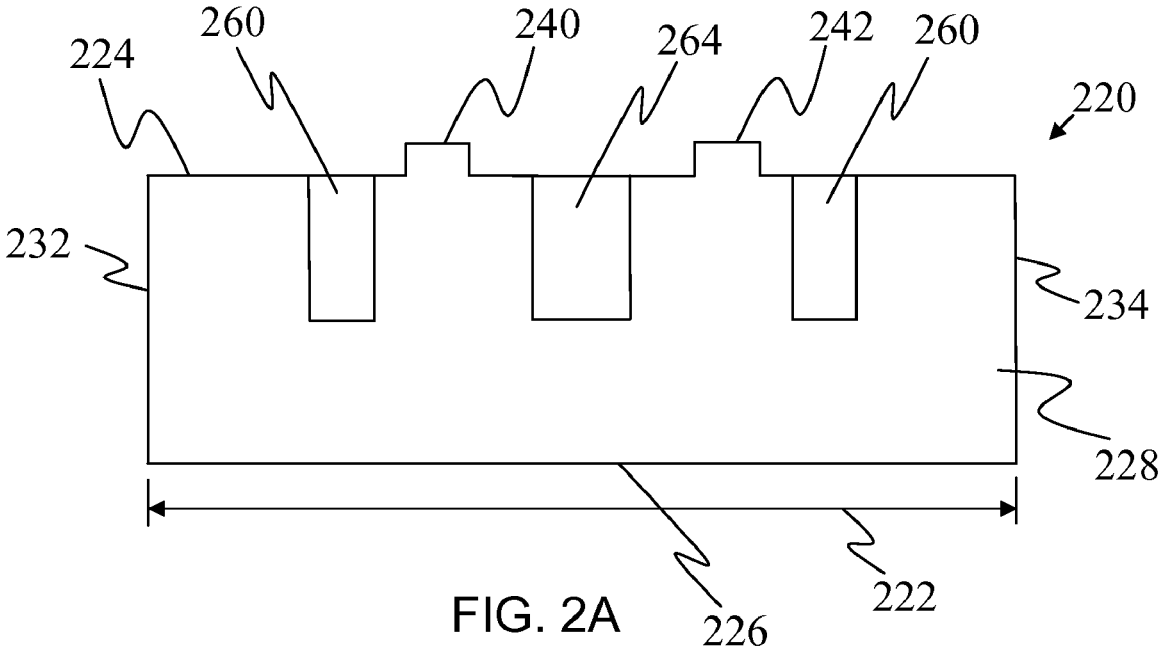
FIG. 2A is a front view of one embodiment of the block tie according to the present invention.
Figure 2B:
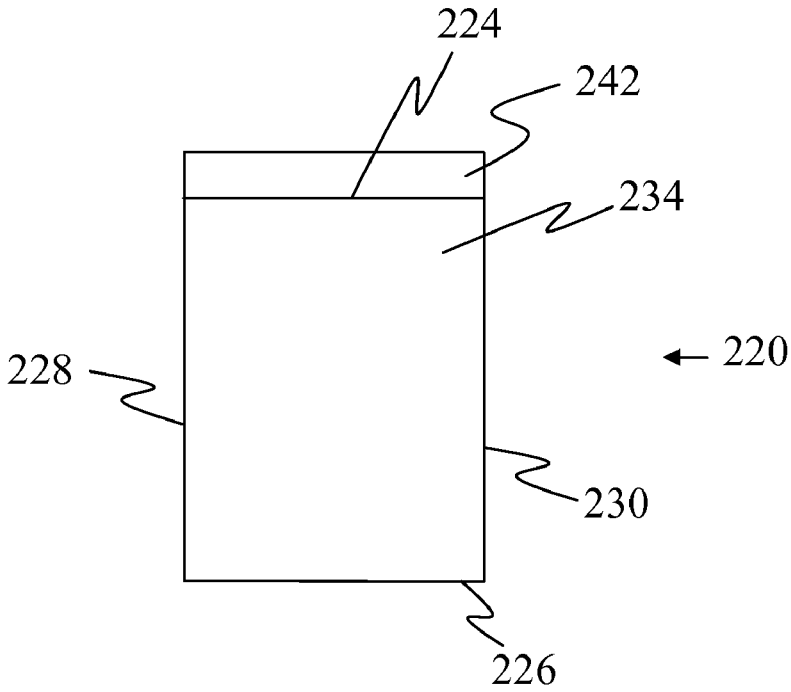
FIG. 2B is an end view of one embodiment of the block tie according to the present invention.
Figure 3A:
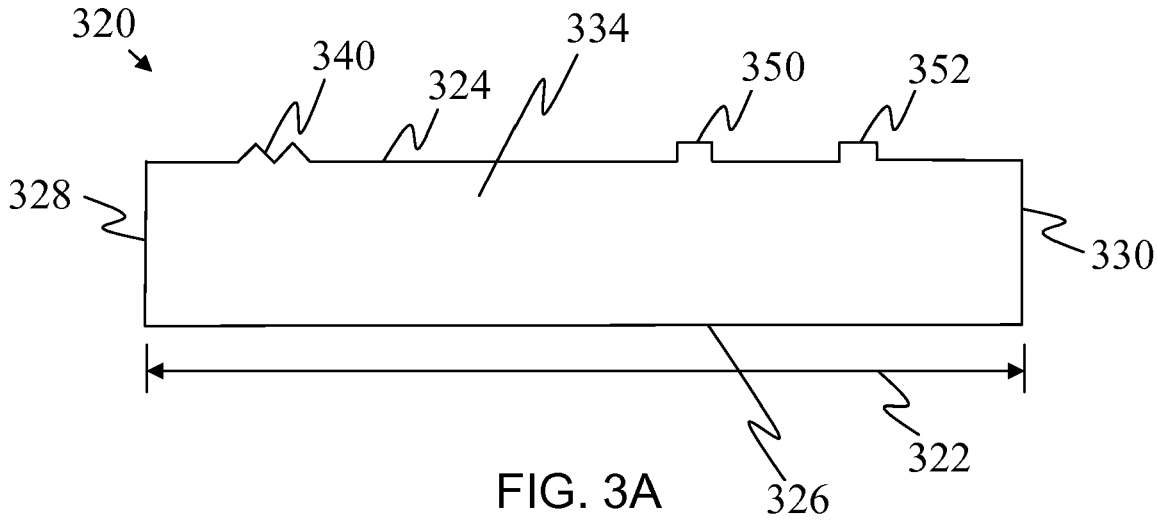
FIG. 3A is a side view of an embodiment of the deadman tie according to the present invention.
Figure 3B:
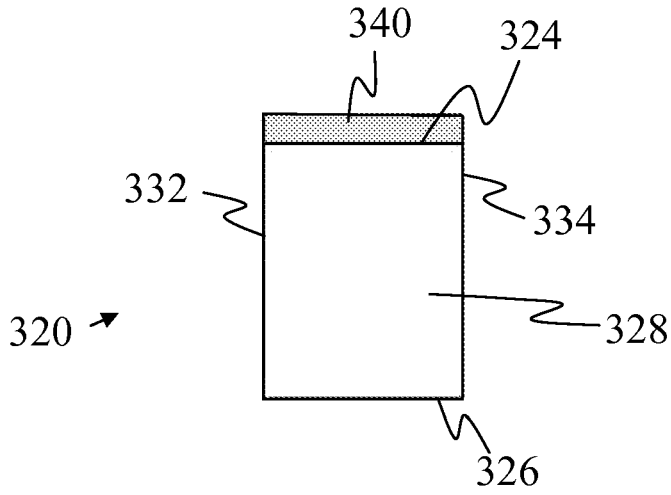
FIG. 3B is a front view of an embodiment of the deadman tie according to the present invention.
Figure 8A:
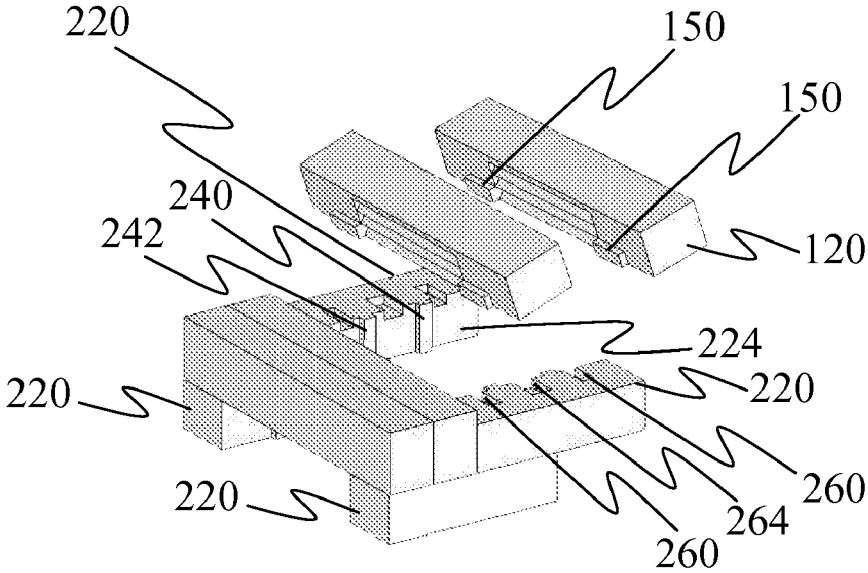
FIG. 8A is a perspective view of another embodiment showing the interlocking stairs assembly according to the present invention.
Figure 8B:
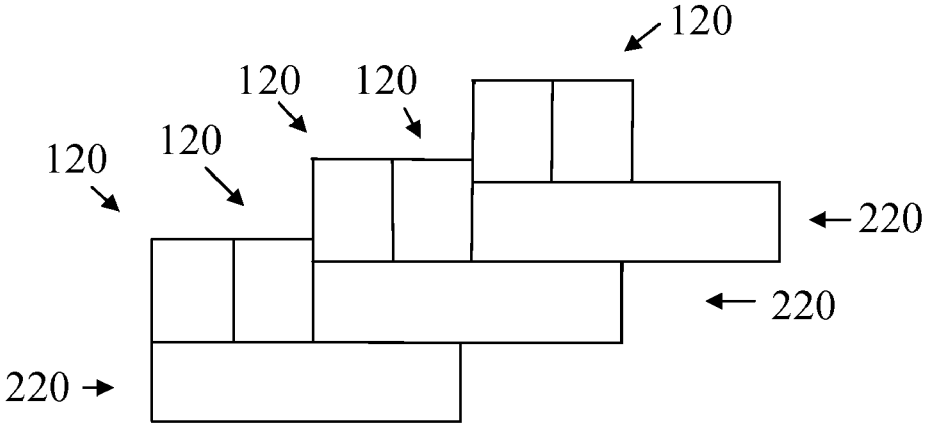
FIG. 8B is a side view of another embodiment showing the interlocking stairs according to the present invention.
Figure 8C:
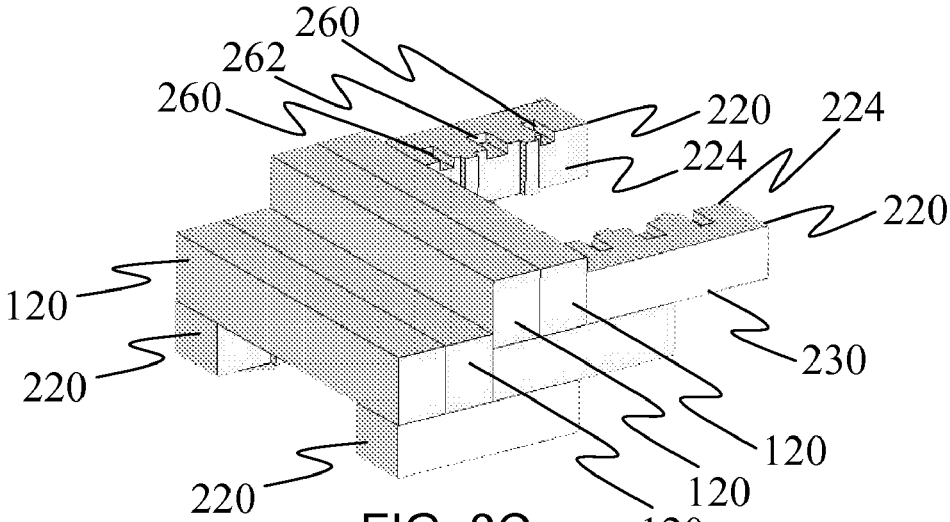
FIG. 8C is another perspective view of another embodiment showing the interlocking stairs assembly according to the present invention.

As depicted in different embodiments in FIGS. 2A and 2B, the block tie 220 includes a length 222 having a substantially rectangular lateral cross-section as may be noted in FIG. 2B. In one embodiment, the block tie 220 may be twenty-seven inches in length 222. The substantially rectangular lateral cross-section width of the block tie 220 may be seven inches and the height of the block tie 220 may be nine inches. The block tie 220 surfaces are designated as an upper side 224, a lower side 226, a front side 228, a rear side 230, a first end 232, and a second end 234. The block tie 220 further includes a pair of ridges 240, 242 with the first ridge 240 and the second ridge 242 disposed on the upper side 224 of the block tie 220. The first ridge 240 and the second ridge 242 may have at least one vertical side and are equally spaced apart from the middle of the length 222 of the block tie 220 slightly wider than the width of the deadman tie 320 as shown in FIGS. 3A, and 3B such that the deadman tie 320 may fit within the space between the block tie 220 first ridge 240 and the second ridge 242. The block tie 220 may be assembled in the retainer tie wall system with the ridges 240, 242 on the upper side 224 in the upward position or the block tie 220 may be inverted with the ridges 240, 242 in the lower position. The ridges 240, 242 may be substantially rectangular ridges with a dimension of approximately two inches horizontal and approximately one inch vertical. The ridges 240, 242 may be spaced slightly over seven inches apart when deadman ties 320 are approximately seven inches in width. The block tie 220 in one embodiment may include a slot 260, 264 on the front side 228 of the block tie 220 wherein the slot 260, 264 begins at the upper side 224 edge of the front side 228 and extends downward. The block tie 220 in one embodiment may include two outer slots 260, or as shown in another embodiment in FIG. 2A, there may be a middle slot 264 between the two outer slots 260 such that the slots 260, 264 may receive a wall tie 120 to form a step, stairs, or series of steps as illustrated in FIGS. 8A, 8B, and 8C. In one embodiment, the distance between the outer slots 260 and the middle slot 264 may be five inches and the distance between the outer slots 260 and the first or second end 232, 234 may be five inches. This would be a distance of five inches between the first or second end 232, 234 and the outer slot 260 or between the outer and middle slots 260, 264 when there are three slots and two of the outer slots 260 are slightly over two inches wide and the middle slot 264 is slightly over three inches wide and the length 222 of the block tie 220 is twenty-seven inches long. The recess of the slots 260, 264 may be slightly over one inch when necessary to accommodate the lip 150 of the wall tie 120. The block tie 220 may be positioned such that two block tie 220 are disposed with the block tie 220 rear side 230 downward and the upper sides 224 of the two block tie 220 facing each other such that the ridges 240, 242 of the two block tie 220 are positioned facing each other as down in FIG. 8A disposed where a wall tie 120 may have been located, thus replacing the wall tie 120 with a step, stairs, or series of steps. Thus the wall tie 120 or pair of wall tie 120 may be disposed on the pair of block tie 220 with the lip 150 of the wall tie 120 interlocking in the block tie 220 slots 260, 264.

As depicted in different embodiments in FIGS. 3A and 3B, the deadman tie 320 includes a length 322 having a substantially rectangular lateral cross-section as noted in FIG. 3B. The deadman tie 320 surfaces are designated as an upper side 324, a lower side 326, a front side 328, a rear side 330, a first side 332, and a second side 334. Two adjoining substantially triangular-shaped tongues 340 are disposed on the upper side 324 of the deadman tie 320, having the triangular-shaped tongue 340 perpendicular to the longitudinal axis of the deadman tie 320, having the two triangular-shaped tongues 340 adjoining, and having the two triangular-shaped tongues 340 disposed approximately two-thirds the width of the deadman tie 320 rearward of the front side 328 of the deadman tie 320. The length of the two triangular-shaped tongue 340 may extend up to the width of the deadman tie 320. In addition, a pair of ridges 350, 352 including a forward ridge 350 and an aft ridge 352 are disposed on the upper side 324 of the deadman tie 320. Each ridge 350, 352 of the pair of ridges 350, 352 have at least one vertical side facing the opposing ridge with the ridges 350, 352 spaced slightly wider than the width of the block tie 220 such that the block tie 220 may fit within the space between the deadman tie 320 forward ridge 350 and the aft ridge 352 and such that the at least one vertical side of each ridge 350, 352 secure the block tie 220 between the pair of ridges 350, 352. Different embodiments may locate the pair of ridges 350, 352 at different locations along the upper side 324 of the deadman tie 320. One embodiment may include the pair of ridges 350, 352 disposed on the rear half of the upper side 324 of the deadman tie 320. Another embodiment may include the aft ridge 352 eight inches from the rear side 330 of the deadman tie 320 with the aft ridge 352 a rectangular-shape approximately one inch high and two inches wide extending across the width of the deadman tie 320 perpendicular to the longitudinal axis of the deadman tie 320 and the forward ridge 350 slightly over seven inches forward of the aft ridge 352 such that the block tie 220 may be secured between the forward and aft ridge 350, 352 with the forward ridge 350 having a rectangular-shape approximately one inch high and two inches wide extending across the width of the deadman tie 320 perpendicular to the longitudinal axis of the deadman tie 320. In one embodiment, the substantially triangular-shaped tongue 340 may be an equilateral triangular-shaped tongue 340 with approximately a two inch base and having the equilateral triangular-shaped tongue 340 extend across the width of the deadman tie 320. In another embodiment or the same embodiment, the deadman tie 320 may have a length 322 of four feet, six feet, or eight feet with a width of seven inches and a height of nine inches. The length 322 of the deadman ties 320 may be shortened from the four feet, six feet, or eight feet lengths as needed for the length necessary in assembling the retainer wall system.

As shown in FIGS. 4A and 4B, the retainer wall tie system 10 has a first layer 420 of the retainer wall wherein the wall tie 120 are disposed on compact subsoil lengthwise to form a retainer wall with first end 132 of a second wall tie 120 disposed lengthwise next to the second end 134 of the first wall tie 120 with this lengthwise disposition of wall tie 120 continuing to form a first layer 420 of the retainer wall continuing lengthwise until the desired length is achieved. Next, a second layer 440 of the retainer wall is disposed above the first layer 420 of the retainer wall wherein the second layer 420 retainer wall may include the deadman tie 320 midpoint disposed over the midpoint of the first wall tie 120 in the first layer 420 retainer wall with the deadman tie 320 disposed perpendicular to the wall ties 120, block tie 220 may be used to support the rear portion of the deadman tie 320 opposite the wall tie 120, and the wall ties 120 are disposed in the second layer 440 above the first layer 420 between the deadman ties 320. Wall ties 120 may be shortened as necessary to make the lengths of the retainer wall come out as desired. The assembly of the retainer wall continues wherein a next layer 450 of the retainer wall may be formed with the disposition of the next wall tie 120 midpoint disposed over a midpoint of the underlying deadman tie 320 such that the substantially triangular-shaped grooves engage the substantially triangular-shaped tongue. Each deadman tie 320 may have a block tie 220 disposed between the ridges of the underlying deadman tie 320 such that the block tie 220 assists in securing and leveling the deadman tie 320. The disposition of the wall tie 120, deadman tie 320, and block tie 220 continue, layer upon layer, until the desired retainer wall height minus one layer is achieved. Next, a top layer 460 of the retainer wall is formed wherein the top layer 460 of the retainer wall is similar to the first layer 420 retainer wall with the wall tie 120 disposed on the previous layer lengthwise with a first end 132 of one wall tie 120 next to the second end 134 of the next wall tie 120 continuing for the desired length.

When an approximate ninety degree corner is desired in the retainer tie system 10 as depicted in FIG. 4D, one wall tie 120 may abut another wall tie 120 approximately perpendicular to form the ninety degree corner for the first layer 420 with the continued lengthwise wall ties 120 disposed in both directions from the corner. With the second layer 440 the wall tie abutment may alternate and overlap the previous layer for additional retainer wall strength. The alternating overlapping abutment for the corner may continue for the next layers 450 and the top layer 460. In order to maintain deadman alignment vertically, the beginning wall unit length may decrease as each additional layer is added. As depicted in FIG. 4E, when an approximate forty-five degree corner is desired in the retainer wall, the wall tie with the forty-five degree angle 121 is disposed abutting another wall tie with the forty-five degree angle 121 at an approximately forty-five degree angle to the previous wall tie with the forty-five degree angle 121 when the desired location for an approximately forty-five degree turn has been reached. The continued lengthwise wall ties 120 are disposed in both directions from the forty-five degree turn having the wall ties with the forty-five degree angle 121. With the second layer 440 the wall ties with the forty-five degree angle 121 abut and may alternate thus overlapping for strengthening the retainer wall as with the ninety degree corners and wall tie 120. Thus for the next layers the wall tie with the forty-five degree angle 121 alternate thus overlapping for the next layers 450. The top layer 460 has the wall ties with the forty-five degree angle 121 disposed at an approximately forty-five degree angle when the desired location for the approximately forty-five degree turn has been reached wherein the wall ties with the forty-five degree angle 121 alternate thus overlapping for strengthening the retainer wall, whereby the retainer wall makes an approximately forty-five degree turn. In order to maintain deadman alignment vertically, the beginning wall unit length may decrease as each additional layer is added.

Figure 5A:
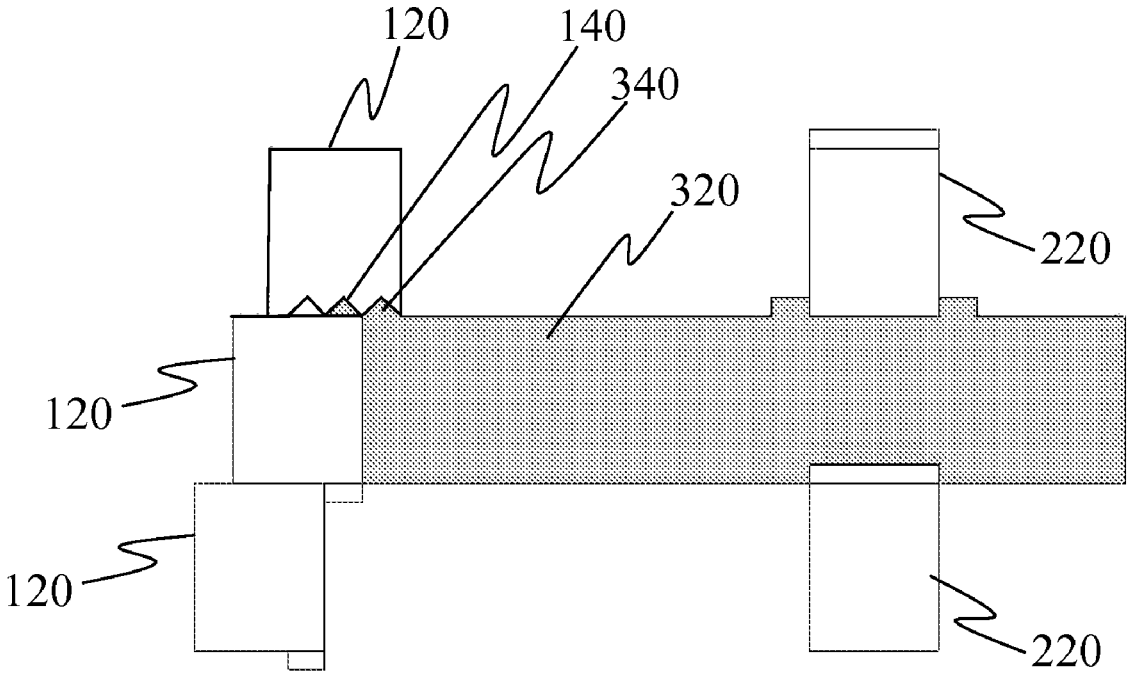
FIG. 5A is a side view of yet another embodiment showing the ridge and groove interlocking for a straight retainer wall according to the present invention.
Figure 5B:
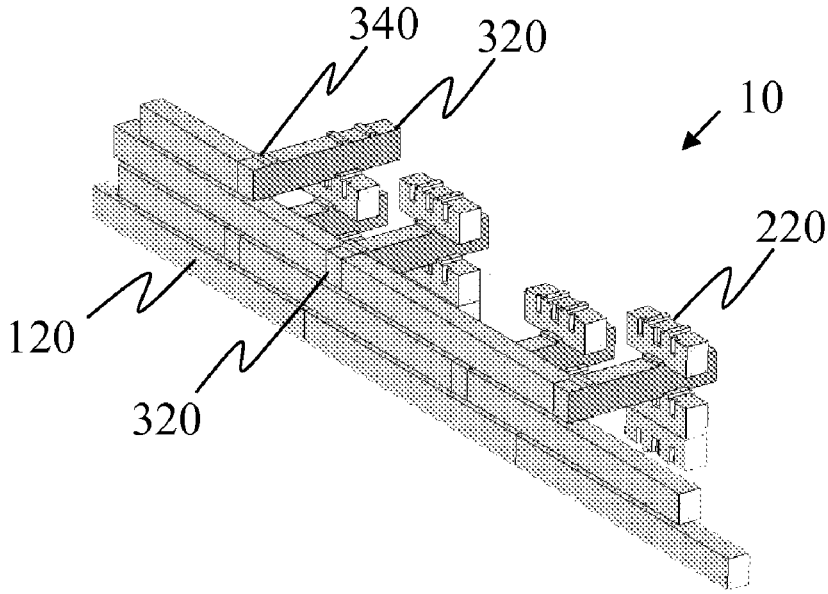
FIG. 5B is a top view of another embodiment showing the assembly for a straight retainer wall according to the present invention.
Figure 6A:
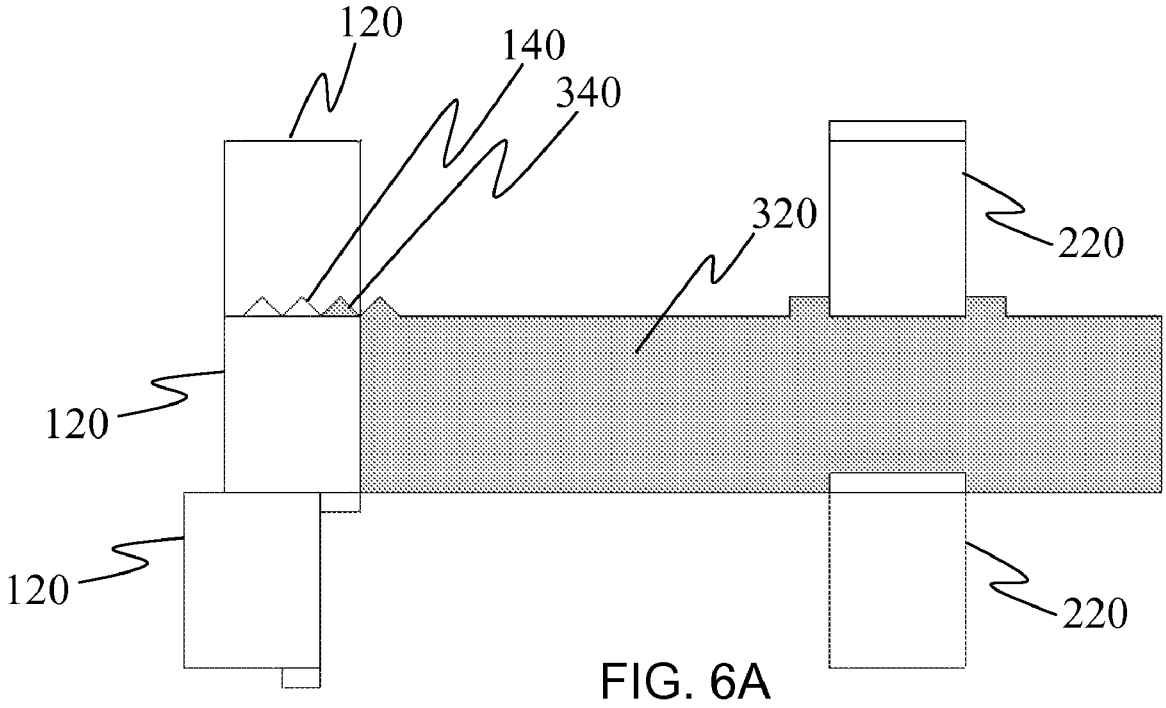
FIG. 6A is a side view of yet another embodiment showing the ridge and groove interlocking for a concave retainer wall according to the present invention.
Figure 6B:
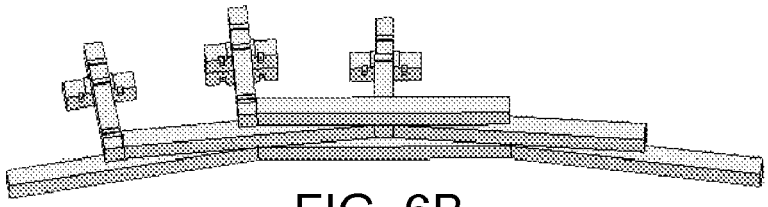
FIG. 6B is a perspective view of another embodiment showing the assembly for a concave retainer wall according to the present invention.
Figure 6C:
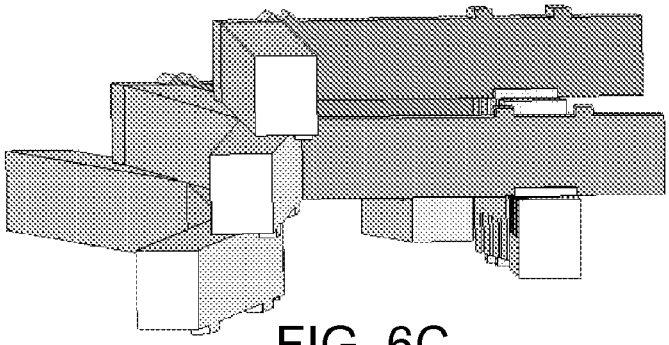
FIG. 6C is another perspective view of another embodiment showing the assembly for a concave retainer wall according to the present invention.
Figure 7A:
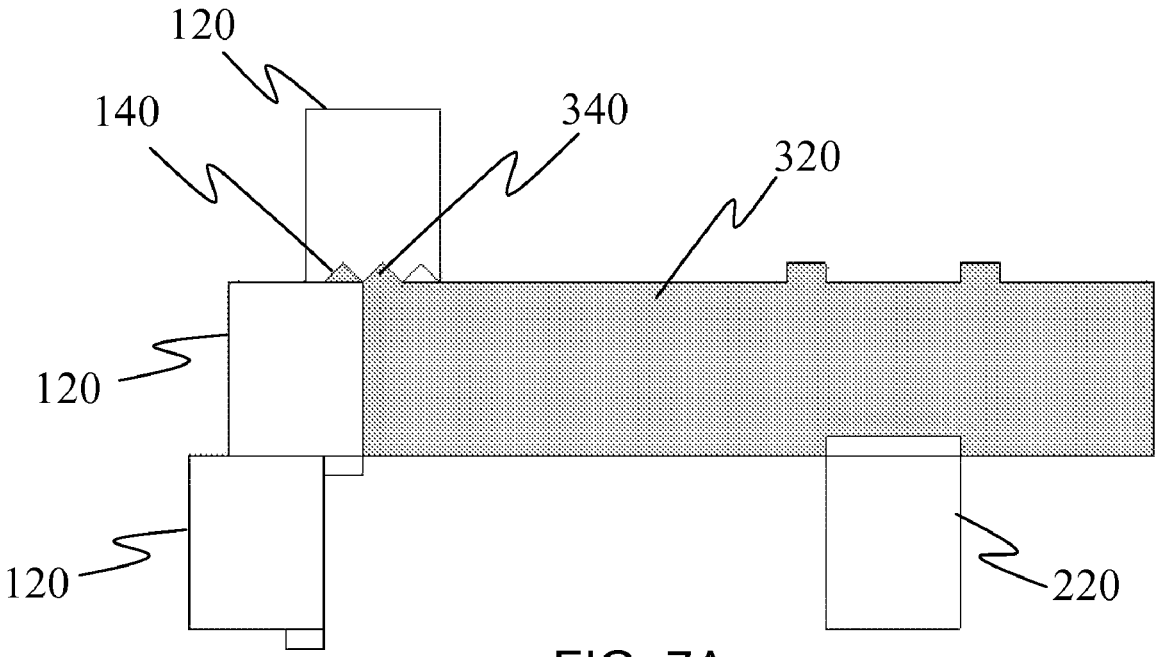
FIG. 7A is a side view of yet another embodiment showing the ridge and groove interlocking for a convex retainer wall according to the present invention.
Figure 7B:
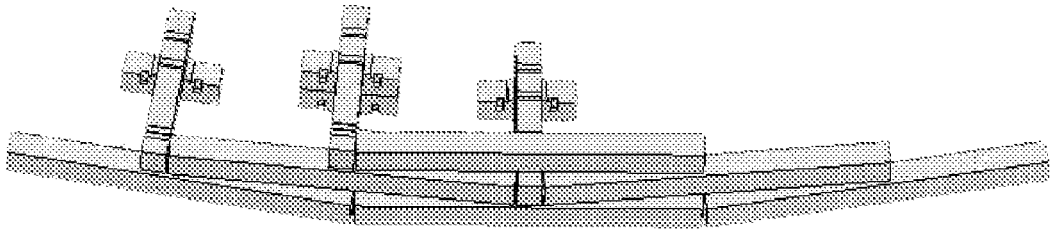
FIG. 7B is a top view of another embodiment showing the assembly for a convex retainer wall according to the present invention.
Figure 7C:
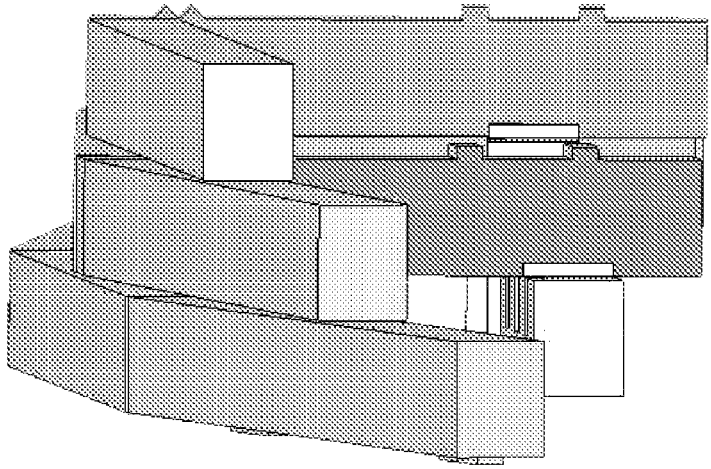
FIG. 7C is a perspective view of another embodiment showing the assembly for a convex retainer wall according to the present invention.

The wall tie three adjoining substantially triangular-shaped grooves interlocking with the deadman tie two triangular-shaped tongue allow for the construction of a straight wall, a concave wall, or a convex wall depending upon the disposition of the wall tie 120 and the alignment of the triangular-shaped tongue and groove. When a straight wall is desired as depicted in FIGS. 5A and 5B, the wall tie 120 are disposed lengthwise to form an approximately straight wall and the deadman tie 320 two triangular-shaped tongues 340 are engaged in the wall tie 120 two most rearward triangular-shaped groves 140. When a concave wall is desired as depicted in FIGS. 6A, 6B and 6C, the wall tie 120 are placed lengthwise and form an approximately concave wall as desired and the wall tie 120 triangular-shaped grooves 140 engage the deadman tie 320 triangular-shaped tongue 340, wherein the forward tongue 340 of deadman tie 320 is placed in most rearward groove 140 of wall tie 120, whereby the retainer wall forms an approximately concave wall. When a convex wall is desired as depicted in FIGS. 7A, 7B and 7C, the wall tie 120 are placed lengthwise and form an approximately convex wall as desired, and the two substantially triangular-shaped tongue 340 of the deadman ties 320 are placed in most forward two grooves 140 of wall tie 120, whereby the retainer wall forms an approximately convex wall.

Manner of Use:

A method of assembling a retainer tie wall system 10 is illustrated in FIGS. 4A, 4B, and 4C comprising the steps of: placing a first layer 420 as a foundation for the retainer tie wall comprising the steps of placing wall tie 120 on compact subsoil lengthwise forming the retainer wall with the second end 134 of a first wall tie 120 disposed lengthwise next to the first end 132 of the another wall tie 120, and continuing to place wall tie 120 lengthwise end to end forming the desired length of retainer wall; placing a second layer 440 disposed above the first layer 420 comprising the steps of locating where deadman ties 320 may be placed over each midpoint of the first layer 420 wall ties 120, placing block ties 220 under the location of the aft portion of where the deadman ties 320 will be placed wherein the block tie 220 will support the deadman ties 320 at the desired aft height, placing deadman ties 320 midpoint disposed over each midpoint of the first layer 420 wall ties 120 with the deadman tie 320 disposed perpendicular to the wall ties 120, placing wall ties 120 disposed between the deadman ties 320 with the lip 150 of the wall tie 120 abutting the rear side 130 of the previous layer wall tie, and continuing lengthwise to form the desired length of retainer wall; placing a next layer 450 disposed above the previous layer comprising the steps of placing wall ties 120 over the midpoints of the deadman ties 320 such that the midpoints of the wall ties 120 are located above the midpoints of the deadman ties 320 and such that the substantially triangular-shaped grooves 140 of the wall ties 120 are engaging the substantially triangular-shaped tongue 340 of the deadman ties 320, placing deadman ties 320 between the first end 132 of one wall tie 120 and the second end 134 of the next lengthwise wall tie 120, placing a block tie 220 disposed between the ridges 350, 352 of the deadman tie 320 such that the block tie 220 assists in securing the deadman tie 320 and the wall tie 120, and continuing lengthwise to form the desired length of retainer wall; continuing the placing a next layers 450 step until the desired retainer wall height minus one layer is achieved; placing a top layer 460 disposed over the previous layer wherein the top layer 460 of the retainer wall is similar to the first layer 420 with the wall tie disposed on the previous layer lengthwise with the first end 132 of one wall tie 120 next to the second end 134 of the next wall tie 120, and continuing for the desired length.

Another method of assembling a retainer tie wall system 10 is illustrated in FIGS. 4A, and 4D, with an approximately ninety degree corner comprising the steps of: placing a first layer 420 as a foundation for the retainer tie wall comprising the steps of placing wall tie 120 on the compact subsoil lengthwise forming the retainer wall with the second end 134 of a first wall tie 120 disposed lengthwise next to the first end 132 of the another wall tie 120, and continuing to place wall tie 120 lengthwise end to end to form the desired length of retainer wall, and placing another wall tie 120 approximately perpendicular to and abutting the last wall tie 120 when the desired location for an approximately ninety degree turn has been reached; placing a second layer 440 disposed above the first layer 420 comprising the steps of locating where deadman ties 320 may be placed over each midpoint of the first layer 420 wall ties 120, placing block ties 220 under the location of the aft portion of where the deadman ties 320 will be placed wherein the block tie 220 will support the deadman ties 320 at the desired aft height, placing deadman ties 320 midpoint disposed over each midpoint of the first layer 420 wall ties 120 with the deadman tie 320 disposed perpendicular to the wall ties 120, placing wall ties 120 disposed between the deadman ties 320 with the lip 150 of the wall tie 120 abutting the rear side 130 of the previous layer wall tie 120, and continuing lengthwise to form the desired length of retainer wall, and placing another wall tie 120 approximately perpendicular to the last wall tie 120 when the desired location for an approximately ninety degree turn has been reached wherein the second layer 440 corner wall tie 120 overlap the first layer 420 corner perpendicular to abutment thus alternating overlapping whereby increasing the strength of the retainer wall wherein to maintain deadman alignment vertically, the beginning wall unit length may decrease as each additional layer is added; placing a next layer 450 disposed above the second layer 440 comprising the steps of placing wall ties 120 over the midpoints of the deadman ties such that the midpoints of the wall ties 120 are located above the midpoints of the deadman ties 320 and such that the triangular-shaped grooves 140 of the wall ties 120 are engaging the triangular-shaped tongue 340 of the deadman ties 320, placing deadman ties 320 between the first end 132 of one wall tie 120 and the second end 134 of the next lengthwise wall tie 120, placing a block tie 220 disposed between the ridges 350, 352 of the deadman tie 320 such that the block tie 220 assists in securing the deadman tie 320 and the wall tie 120, and continuing lengthwise to form the desired length of retainer wall, and placing another wall tie 120 approximately perpendicular to the last wall tie 120 when the desired location for an approximately ninety degree turn has been reached wherein the current layer corner wall tie 120 overlap the previous layer corner abutment thus continuing the alternating overlapping; continuing the placing a next layers 450 step until the desired retainer wall height minus one layer is achieved; placing a top layer 460 disposed over the previous layer wherein the top layer 460 of the retainer wall is similar to the first layer 420 with the wall tie 120 disposed on the previous layer lengthwise with the first end 132 of one wall tie 120 next to the second end 134 of the next wall tie 120, and continuing for the desired length, and placing another wall tie 120 approximately perpendicular to the last wall tie 120 when the desired location for an approximately ninety degree turn has been reached wherein the top layer 460 corner wall tie 120 overlap the previous layer corner abutment thus alternating overlapping; whereby the retainer wall makes a ninety degree turn.

A method of assembling a retainer tie wall system 10 is illustrated in FIGS. 4A, 4C,and 4E with an approximately forty-five degree turn comprising the steps of: placing a first layer 420 as a foundation for the retainer tie wall comprising the steps of placing wall tie 120 on the compact subsoil lengthwise forming the retainer wall with the second end 134 of a first wall tie 120 disposed lengthwise next to the first end 132 of the another wall tie 120, and continuing to place wall tie 120 lengthwise end to end forming the desired length of retainer wall, and replacing the last wall tie 120 with a wall tie with the forty-five degree angle 121 when the desired location for an approximately forty-five degree turn has been reached and abutting the degree wall tie with the forty-five degree angle 121 with another wall tie with the forty-five degree angle 121 at an approximately forty-five degree angle to the previous wall tie with the forty-five degree angle 121; placing a second layer 440 disposed above the first layer 420 comprising the steps of locating where deadman ties 320 may be placed over each midpoint of the first layer 420 wall ties 120, placing block ties 220 under the location of the aft portion of where the deadman ties 320 will be placed wherein the block tie 220 will support the deadman ties 320 at the desired aft height, placing deadman ties 320 midpoint disposed over each midpoint of the first layer 420 wall ties 120 with the deadman tie 320 disposed perpendicular to the wall ties 120, placing wall ties 120 disposed between the deadman ties 320 with the lip 150 of the wall tie 120 abutting the rear side 130 of the previous layer wall tie 120, and continuing lengthwise to form the desired length of retainer wall, and replacing the last wall tie 120 with the wall tie with the forty-five degree angle 121 when the desired location for an approximately forty-five degree turn has been reached and abutting the wall tie with the forty-five degree angle 121 with another wall tie with the forty-five degree angle 121 at an approximately forty-five degree angle to the previous wall tie with the forty-five degree angle 121 wherein the wall ties with the forty-five degree angle 121 abut and may alternate thus overlapping for strengthening the retainer wall, and wherein to maintain deadman alignment vertically, the beginning wall unit length may decrease as each additional layer is added; placing a next layer 450 disposed above the previous layer comprising the steps of placing wall ties 120 over the midpoints of the deadman ties 320 such that the midpoints of the wall ties 120 are located above the midpoints of the deadman ties 320 and such that the triangular-shaped grooves 140 of the wall ties 120 are engaging the triangular-shaped tongue 340 of the deadman ties 320, placing deadman ties 320 between the first end 132 of one wall tie 120 and the second end 134 of the next lengthwise wall tie 120, placing a block tie 220 disposed between the ridges 350, 352 of the deadman tie 320 such that the block tie 220 assists in securing the deadman tie 320 and the wall tie 120, and continuing lengthwise to form the desired length of retainer wall, and replacing the last wall tie 120 with the wall tie with the forty-five degree angle 121 when the desired location for an approximately forty-five degree turn has been reached and abutting the wall tie with the forty-five degree angle 121 with another wall tie with the forty-five degree angle 121 at an approximately forty-five degree angle to the previous wall tie with the forty-five degree angle 121 wherein the wall ties with the forty-five degree angle 121 abut and may alternate thus overlapping for strengthening the retainer wall; continuing the placing a next layers 450 step until the desired retainer wall height minus one layer is achieved; placing a top layer 460 disposed over the previous layer wherein the top layer 460 of the retainer wall is similar to the first layer 420 with the wall tie 120 disposed on the previous layer lengthwise with the first end 132 of one wall tie 120 next to the second end 134 of the next wall tie 120, and continuing for the desired length, and replacing the last wall tie 120 with the wall tie with the forty-five degree angle 121 when the desired location for an approximately forty-five degree turn has been reached and abutting the wall tie with the forty-five degree angle 121 with another wall tie with the forty-five degree angle 121 at an approximately forty-five degree angle to the previous wall tie with the forty-five degree angle 121 wherein the wall ties with the forty-five degree angle 121 abut and may alternate thus overlapping for strengthening the retainer wall; and whereby the retainer wall makes an approximately forty-five degree turn.

A method of assembling an approximately straight retainer tie wall system 10 is illustrated in FIGS. 4A, 4B, 4C, 5A, and 5B comprising the steps of: placing a first layer 420 as a foundation for the retainer tie wall comprising the steps of placing wall tie 120 on the compact subsoil lengthwise forming the retainer wall with the second end 134 of a first wall tie 120 disposed lengthwise next to the first end 132 of the another wall tie 120 such that the wall tie 120 are placed lengthwise and form an approximately straight wall as desired, and continuing to place wall tie 120 lengthwise end to end forming the desired length of retainer wall; placing a second layer 440 disposed above the first layer 420 comprising the steps of locating where deadman ties 320 may be placed over each midpoint of the first layer 420 wall ties 120, placing block ties 220 under the location of the aft portion of where the deadman ties 320 will be placed wherein the block tie 220 will support the deadman ties 320 at the desired aft height, placing deadman ties 320 midpoint disposed over each midpoint of the first layer 420 wall ties 120 with the deadman tie 320 disposed perpendicular to the wall ties 120, placing wall ties 120 disposed between the deadman ties 320 with the lip 150 of the wall tie 120 abutting the rear side 130 of the previous layer wall tie 120, and continuing lengthwise to form the desired length of retainer wall; placing a next layer 450 disposed above the previous layer comprising the steps of placing wall ties 120 over the midpoints of the deadman ties 320 such that the midpoints of the wall ties 120 are located above the midpoints of the deadman ties 320 and such that the triangular-shaped grooves 140 of the wall ties 120 are engaging the triangular-shaped tongue 340 of the deadman ties 320, wherein the two substantially triangular-shaped tongue 340 of deadman tie 320 are placed in two most rearward triangular-shaped grooves 140 of wall tie 120, whereby the retainer wall forms an approximately straight wall, placing deadman ties 320 between the first end 132 of one wall tie 120 and the second end 134 of the next lengthwise wall tie 120, placing a block tie 220 disposed between the ridges 350, 352 of the deadman tie 320 such that the block tie 220 assists in securing the deadman tie 320 and the wall tie 120, and continuing lengthwise to form the desired length of retainer wall; continuing the placing a next layers 450 step until the desired retainer wall height minus one layer is achieved; placing a top layer 460 disposed over the previous layer wherein the top layer 460 of the retainer wall is similar to the first layer 420 with the wall tie 120 disposed on the previous layer lengthwise with the first end 132 of one wall tie 120 next to the second end 134 of the next wall tie 120, and continuing for the desired length.

A method of assembling a concave retainer tie wall system 10 is illustrated in FIGS. 4A, 4C, 6A, 6B, and 6C comprising the steps of: placing a first layer 420 as a foundation for the retainer tie wall comprising the steps of placing wall tie 120 on the compact subsoil lengthwise forming the retainer wall with the second end 134 of a first wall tie 120 disposed lengthwise next to the first end 132 of the another wall tie 120 such that the wall tie 120 are placed lengthwise and form an approximately concave wall as desired, and continuing to place wall tie 120 lengthwise end to end forming the desired length of retainer wall; placing a second layer 440 disposed above the first layer 420 comprising the steps of locating where deadman ties 320 may be placed over each midpoint of the first layer 420 wall ties 120, placing block ties 220 under the location of the aft portion of where the deadman ties 320 will be placed wherein the block tie 220 will support the deadman ties 320 at the desired aft height, placing deadman ties 320 midpoint disposed over each midpoint of the first layer 420 wall ties 120 with the deadman tie 320 disposed perpendicular to the wall ties 120, placing wall ties 120 disposed between the deadman ties 320 with the lip 150 of the wall tie 120 abutting the rear side 130 of the previous layer wall tie 120, and continuing lengthwise to form the desired length of retainer wall; placing a next layer 450 disposed above the previous layer comprising the steps of placing wall ties 120 over the midpoints of the deadman ties 320 such that the midpoints of the wall ties 120 are located above the midpoints of the deadman ties 320 and such that the triangular-shaped grooves 140 of the wall ties 120 are engaging the triangular-shaped tongue 340 of the deadman ties 320 wherein the forward triangular-shaped tongue 340 of deadman tie 320 is placed in most rearward triangular-shaped groove 140 of wall tie 120, whereby the retainer wall forms an approximately concave wall, placing deadman ties 320 between the first end 132 of one wall tie 120 and the second end 134 of the next lengthwise wall tie 120, placing a block tie 220 disposed between the ridges 350, 352 of the deadman tie 320 such that the block tie 220 assists in securing the deadman tie 320 and the wall tie 120, and continuing lengthwise to form the desired length of retainer wall; continuing the placing a next layers 450 step until the desired retainer wall height minus one layer is achieved; placing a top layer 460 disposed over the previous layer wherein the top layer 460 of the retainer wall is similar to the first layer 420 with the wall tie 120 disposed on the previous layer lengthwise with the first end 132 of one wall tie 120 next to the second end 134 of the next wall tie 120, and continuing for the desired length.

A method of assembling a convex retainer tie wall system 10 is illustrated in FIGS. 4A, 4C, 7A, 7B, and 7C comprising the steps of: placing a first layer 420 as a foundation for the retainer tie wall comprising the steps of placing wall tie 120 on the compact subsoil lengthwise forming the retainer wall with the second end 134 of a first wall tie 120 disposed lengthwise next to the first end 132 of the another wall tie 120 such that the wall tie 120 are placed lengthwise and form an approximately convex wall as desired, and continuing to place wall tie 120 lengthwise end to end forming the desired length of retainer wall; placing a second layer 440 disposed above the first layer 420 comprising the steps of locating where deadman ties 320 may be placed over each midpoint of the first layer 420 wall ties 120, placing block ties 220 under the location of the aft portion of where the deadman ties 320 will be placed wherein the block tie 220 will support the deadman ties 320 at the desired aft height, placing deadman ties 320 midpoint disposed over each midpoint of the first layer 420 wall ties 120 with the deadman tie 320 disposed perpendicular to the wall ties 120, placing wall ties 120 disposed between the deadman ties 320 with the lip 150 of the wall tie 120 abutting the rear side 130 of the previous layer wall tie 120, and continuing lengthwise to form the desired length of retainer wall; placing a next layer 450 disposed above the previous layer comprising the steps of placing wall ties 120 over the midpoints of the deadman ties 320 such that the midpoints of the wall ties 120 are located above the midpoints of the deadman ties 320 and such that the triangular-shaped grooves 140 of the wall ties 120 are engaging the triangular-shaped tongue 340 of the deadman ties 320 wherein the two substantially triangular-shaped tongue 340 of the deadman ties 320 are placed in most forward two triangular-shaped grooves 140 of wall tie 120, whereby the retainer wall forms an approximately convex wall, placing deadman ties 320 between the first end 132 of one wall tie 120 and the second end 134 of the next lengthwise wall tie 120, placing a block tie 220 disposed between the ridges 350, 352 of the deadman tie 320 such that the block tie 220 assists in securing the deadman tie 320 and the wall tie 120, and continuing lengthwise to form the desired length of retainer wall; continuing the placing a next layers 450 step until the desired retainer wall height minus one layer is achieved; placing a top layer 460 disposed over the previous layer wherein the top layer 460 of the retainer wall is similar to the first layer 420 with the wall tie 120 disposed on the previous layer lengthwise with the first end 132 of one wall tie 120 next to the second end 134 of the next wall tie 120, and continuing for the desired length.

A method of assembling a retainer tie wall system 10 is illustrated in FIGS. 4A, 4B, and 4C comprising the steps of: placing a first layer 420 as a foundation for the retainer tie wall comprising the steps of placing wall tie 120 on the compact subsoil lengthwise forming the retainer wall with the second end 134 of a first wall tie 120 disposed lengthwise next to the first end 132 of the another wall tie 120, and continuing to place wall tie 120 lengthwise end to end forming the desired length of retainer wall, wherein at the desired location for a stairs as depicted in FIGS. 8A, 8B, and 8C, further comprising another step of: replacing the wall tie 120 with a pair of block tie 220 disposed perpendicular to the retainer tie wall wherein the block tie 220 may be placed with the rear side 230 downward and the upper sides 224 of the pair of block tie 220 facing each other; placing a pair of wall tie 120 such that the wall tie 120 lip 150 are interlocked in the block tie 220 slots 260, 264; placing another pair of block tie 220 disposed on the further portion from the retainer tie wall of the previous block tie 220 oriented in the same way as the previous block tie 220 and continuing the replacing the wall tie 120, placing a pair of wall tie 120, placing another pair of block tie 220, and continuing steps until the desired height of the stairs is reached; placing a second layer 440 disposed above the first layer 420 comprising the steps of locating where deadman ties 320 may be placed over each midpoint of the first layer 420 wall ties 120, placing block ties 220 under the location of the aft portion of where the deadman ties 320 will be placed wherein the block tie 220 will support the deadman ties 320 at the desired aft height, placing deadman ties 320 midpoint disposed over each midpoint of the first layer 420 wall ties 120 with the deadman tie 320 disposed perpendicular to the wall ties 120, placing wall ties 120 disposed between the deadman ties 320 with the lip 150 of the wall tie 120 abutting the rear side 130 of the previous layer wall tie, and continuing lengthwise to form the desired length of retainer wall; placing a next layer 450 disposed above the previous layer comprising the steps of placing wall ties 120 over the midpoints of the deadman ties 320 such that the midpoints of the wall ties 120 are located above the midpoints of the deadman ties 320 and such that the substantially triangular-shaped grooves 140 of the wall ties 120 are engaging the substantially triangular-shaped tongue 340 of the deadman ties 320, placing deadman ties 320 between the first end 132 of one wall tie 120 and the second end 134 of the next lengthwise wall tie 120, placing a block tie 220 disposed between the ridges 350, 352 of the deadman tie 320 such that the block tie 220 assists in securing the deadman tie 320 and the wall tie 120, and continuing lengthwise to form the desired length of retainer wall; continuing the placing a next layers 450 step until the desired retainer wall height minus one layer is achieved; placing a top layer 460 disposed over the previous layer wherein the top layer 460 of the retainer wall is similar to the first layer 420 with the wall tie disposed on the previous layer lengthwise with the first end 132 of one wall tie 120 next to the second end 134 of the next wall tie 120, and continuing for the desired length.

What is claimed is:

1. A retainer tie system comprising the combination of a wall tie, a block tie, and a deadman tie:

the wall tie including:

a length having a substantially rectangular lateral cross-section and an upper side, a lower side, a front side, a rear side, a first end, and a second end;

three adjoining substantially triangular-shaped grooves extending from a middle of the lower side of the wall tie toward the first end and second end of the wall tie wherein the rear lower edge of the rearward substantially triangular-shaped groove is disposed where the rear side and the lower side adjoin wherein the length of the substantially triangular-shaped grooves is approximately one half of the length of the wall tie, a lip disposed on the lower side of the wall tie where the rear side and the lower side adjoin wherein one end of the lip is disposed adjacent the end of the substantially triangular-shaped groove and the lip extends vertically downward and horizontally toward the closest end of the wall tie along the rear of the lower side for approximately half the distance from the end of the substantially triangular-shaped groove to the end of the wall tie;

the block tie including:

a length having a substantially rectangular lateral cross-section and an upper side, a lower side, a front side, a rear side, a first end, and a second end, a first ridge with at least one vertical side, and a second ridge with at least one vertical side, the first and second ridge are disposed on the upper side of the block tie wherein the first and second ridges are equally spaced apart from the middle of the length of the block tie slightly wider than a width of the deadman tie such that the block tie may fit across the deadman tie within the space between the block tie first ridge and second ridge; and the deadman tie including:

a length having a substantially rectangular lateral cross-section, and an upper side, a lower side, a front side, a rear side, a first side, and a second side;

two triangular-shaped tongue disposed on the upper side of the deadman tie perpendicular to the longitudinal axis of the deadman tie approximately two thirds the width of the deadman tie, rearward of the front side of the deadman tie;

a forward ridge disposed on the upper side of the deadman tie;

an aft ridge disposed on the upper side of the deadman tie wherein the aft ridge is set apart from the forward ridge slightly wider than the width of the block tie such that the block tie may fit between the forward and aft ridge and the aft ridge and forward ridge are disposed on the deadman tie upper side within one half the length of the deadman tie from the rear side; and whereby the retainer wall system having a first layer of the retainer wall having the wall tie disposed on compact subsoil lengthwise to form a retainer wall with first end of another wall tie disposed lengthwise next to the second end of the first wall tie continuing to form a first layer of the retainer wall continuing 1engthwise to the desired length;

a second layer of the retainer wall disposed above the first layer of the retainer wall the second layer retainer wall including the deadman tie midpoint disposed over each midpoint of the first layer retainer wall with the deadman tie disposed perpendicular to the wall ties, and the wall ties disposed between the deadman ties, with the block tie disposed between the forward and aft ridges of the deadman tie;

a next layer of the retainer wall may be formed by disposing the wall tie midpoint over a midpoint of a deadman tie such that the triangular-shaped grooves engage the triangular-shaped tongue furthermore each deadman tie may have a block tie disposed between the rectangular ridges of the deadman tie such that the block tie assists in securing the deadman tie, and the wall tie continuing the layers until the desired retainer wall height is achieved; and a top layer of the retainer wall formed wherein the top layer of the retainer wall is similar to the first layer retainer wall with the wall tie disposed on the previous layer lengthwise with a first end of one wall tie next to the second end of the next wall tie continuing for the desired length.

2. The retainer tie system according to claim 1 wherein the wall tie, the block tie, and the deadman tie comprise a pre-cast concrete construction material.

3. A wall tie comprising:

a length having a substantially rectangular lateral cross-section and an upper side, a lower side, a front side, a rear side, a first end, and a second end;

three adjoining substantially triangular-shaped grooves extending parallel with the longitudinal axis of the wall tie from a middle of the lower side of the wall tie toward the first end and second end of the wall tie wherein the rear lower edge of the rearward substantially triangular-shaped groove is disposed where the rear side and the lower side adjoin wherein the length of the substantially triangular-shaped grooves is approximately one half of the length of the wall tie; and a lip disposed on the lower side of the wall tie where the rear side and the lower side adjoin wherein one end of the lip is disposed adjacent the end of the substantially triangular-shaped groove and the lip extends toward the closest end of the wall tie along the rear of the lower side for approximately half the distance from the end of the substantially triangular-shaped groove to the end of the wail tie.

4. The wall tie according to claim 3 wherein the wall tie substantially rectangular lateral cross-section dimensions are nine inches high by seven inches wide, the triangular-shaped grooves have a triangular base dimension of two inches and a length of fifty inches, the lip on the lower side of the wall tie is a pair of lips with a two inch width by one inch height rectangular cross-section and an eleven inch length; and the wall tie length is a length dimension selected from a group consisting of: four feet, six feet, or eight feet.

5. The wail tie according to claim 3 wherein the wall tie length is four feet the wall tie substantially rectangular lateral cross-section dimension is nine inches high by seven inches wide, the triangular-shaped grooves have a triangular base dimension of two inches and a length of twenty-four inches, the lip on the lower side of the wall tie is a pair of lips with a two inch by one inch cross-section and a six inch length.

6. The wall tie according to claim 3 wherein the wall tie front side includes a pea gravel finish.

7. The wall tie according to claim 3 wherein the wall tie front side includes a limestone finish.

8. The wall tie according to claim 3 wherein the wall tie first end includes an approximately forty-five degree angle whereby a retainer tie system may include an approximate forty-five degree turn in the length of the system in either direction.

9. The wall tie according to claim 3 wherein the wall tie second end includes a forty-five degree angle such that looking at a top view the wall tie front side length is longer than the wail tie rear side length whereby a retainer tie system may include a forty-five degree turn in the length of the system.

10. A method of assembling a retainer tie wall system with wail tie as set forth in claim 3, comprising the steps of:

placing a first layer as a foundation for a retainer wall comprising the steps of placing the wall tie on compact subsoil lengthwise forming the retainer wall with the second end of a first wall tie disposed lengthwise next to the first end of the another wall tie, and continuing to place the wall tie lengthwise end to end forming the desired length of the retainer wall;

placing a second layer disposed above the first layer comprising the steps of locating where deadman ties may be placed over each midpoint of the first layer wail ties, placing block ties under the location of the aft portion of where the deadman ties will be placed wherein the block tie will support the deadman ties at the desired aft height. placing the deadman ties midpoint disposed over each midpoint of the first layer wall ties with the deadman tie disposed perpendicular to the wall ties, placing the wall ties disposed between the deadman ties with the lip of the wail tie abutting the rear side of the previous layer wall tie, and continuing lengthwise to form the desired length of retainer wall;

placing a next layer disposed above the previous layer comprising the steps of placing the wall ties over the midpoints of the deadman ties such that the midpoints of the wall ties are located above the midpoints of the deadman ties and such that the substantially triangular-shaped grooves of the wall ties are engaging substantially triangular-shaped tongue of the deadman ties, placing deadman ties between the first end of one wall tie and the second end of the next lengthwise wall tie, placing a block tie disposed between ridges of the deadman tie such that the block tie assists in securing the deadman tie and the wall tie, and continuing lengthwise to form the desired length of the retainer wall;

continuing the placing the next layers step until the desired retainer wall height minus one layer is achieved;

placing a top layer disposed over the previous layer wherein the top layer of the retainer wall is similar to the first layer with the wall tie disposed on the previous layer lengthwise with the first end of one wall tie next to the second end of the next wall tie, and continuing for the desired length.

11. A method of claim 10, wherein the step of placing a first layer step of continuing placing wall tie lengthwise end to end to form the desired length of retainer wall further comprises the step of: placing another wall tie approximately perpendicular to and abutting the last wall tie when the desired location for an approximately ninety degree turn has been reached; the step of placing a second layer, step of continuing lengthwise to form the desired length of retainer wall further comprises the step of: placing another wall tie approximately perpendicular to the last wall tie when the desired location for an approximately ninety degree turn has been reached wherein the second layer corner wall tie overlap the first layer corner perpendicular to abutment thus alternating overlapping whereby increasing the strength of the retainer wail wherein to maintain deadman alignment vertically, the beginning wall unit length may decrease as each additional layer is added; the step of placing a next layer step of continuing lengthwise to form the desired length of retainer wall further comprises the step of: placing another wall tie approximately perpendicular to the last wail tie when the desired location for an approximately ninety degree turn has been reached wherein the current layer corner wall tie overlap the previous layer corner abutment thus continuing the alternating overlapping; and the step of placing a top layer step of continuing for the desired length further comprises the step of: placing another wall tie approximately perpendicular to the last wall tie when the desired location for an approximately ninety degree turn has been reached wherein the top layer corner wall tie overlap the previous layer corner abutment thus alternating overlapping; whereby the retainer wall makes a ninety degree turn.

12. A method of claim 10, wherein the step of placing a first layer step of continuing placing wall tie lengthwise end to end to form the desired length of retainer wall further comprises the step of: replacing the last wall tie with the wall tie with the forty-five degree angle of claim 8 when the desired location for an approximately forty-five degree turn has been reached and abutting the wail tie with the forty-five degree angle with another wall tie with the forty-five degree angle at an approximately forty-five degree angle to the previous wall tie with the forty-five degree angle; the step of placing a second layer step of continuing lengthwise to form the desired length of retainer wall further comprises the step of: replacing the last wall tie with the wall tie with the forty-five degree angle when the desired location for an approximately forty-five turn has been reached and abutting the wall tie with the forty-five degree angle with another wall tie with the forty-five degree angle at an approximately forty-five degree angle to the previous wall tie with the forty-five degree angle wherein the wall ties with the forty-five degree angle abut and may alternate thus overlapping for strengthening the retainer wall, and wherein to maintain deadman alignment vertically, the beginning wall unit length may decrease as each additional layer is added; the step of replacing a next layer step of continuing lengthwise to form the desired length of retainer wall further comprises the step of: replacing the last wall tie with the wall tie with the forty-five degree angle when the desired location for an approximately forty-five degree turn has been reached and abutting the wall tie with the forty-five degree angle with another wall tie with the forty-five degree angle at an approximately forty-five degree angle to the previous wall tie with the forty-five degree angle wherein the wall ties with the forty-five degree angle abut and may alternate thus overlapping for strengthening the retainer wall; and the step of placing a top layer step of continuing for the desired length further comprises the step of: replacing the last wall tie with the wall tie with the forty-five degree angle when the desired location for an approximately forty-five degree turn has been reached and abutting the wall tie with the forty-five degree angle with another wall tie with the forty-five degree angle at an approximately forty-five degree angle to the previous wall tie with the forty-five degree angle wherein the wall tie with the forty-five degree angle abut and may alternate thus overlapping for strengthening the retainer wail; whereby the retainer wall makes an approximately forty-five degree turn.

13. A method of claim 10, wherein the step of placing a first layer step of placing wail tie on compact subsoil lengthwise forming the retainer wall with the second end of a first wall tie disposed lengthwise next to the first end of the another wall tie is such that the wall tie are placed lengthwise and form an approximately straight wall as desired: and wherein the step of placing a next layer step of placing wall ties over the midpoints of the deadman ties such that the midpoints of the wall ties are located above the midpoints of the deadman ties and such that the substantially triangular-shaped grooves of the wall ties are engaging the substantially triangular-shaped tongue of the deadman ties, wherein the two substantially triangular-shaped tongue of deadman tie are placed in two most rearward substantially triangular-shaped grooves of wall tie, whereby the retainer wall forms an approximately straight wall.

14. A method of claim 10, wherein the step of placing a first layer step of placing wall tie on compact subsoil lengthwise forming the retainer wall with the second end of a first wall tie disposed lengthwise next to the first end of the another wall tie is such that the wall tie are placed lengthwise and form an approximately concave wall as desired; and wherein the step of placing a next layer step of placing wall ties over the midpoints of the deadman ties such that the midpoints of the wall ties are located above the midpoints of the deadman ties and such that the substantially triangular-shaped grooves of the wall ties are engaging the substantially triangular-shaped tongue of the deadman ties, wherein the forward substantially triangular-shaped tongue of deadman is placed in most rearward substantially triangular-shaped groove of wall tie, whereby the retainer wall forms an approximately concave wall.

15. A method of claim 10, wherein the step of placing a first layer step of placing wall tie on compact subsoil lengthwise forming the retainer wall with the second end of a first wall tie disposed lengthwise next to the first end of the another wall tie is such that the wall tie are placed lengthwise and form an approximately convex wall as desired; and wherein the step of placing a next layer step of placing wall ties over the midpoints of the deadman ties such that the midpoints of the wail ties are located above the midpoints of the deadman ties and such that the substantial triangular-shaped grooves of the wall ties are engaging the substantially triangular-shaped tongue of the deadman ties, wherein the two substantially triangular-shaped tongue of the deadman ties are placed in most forward two substantially triangular-shaped grooves of wall tie, whereby the retainer wall forms an approximately convex wall.

16. A method of claim 10, wherein at the desired location for a stairs, after the placing a first layer steps further comprising another step of; replacing the wall tie with a pair of block tie disposed perpendicular to the retainer tie wall wherein the block tie may be placed with the rear side downward and the upper sides of the pair of block tie facing each other; placing a pair of wall tie such that the wall tie lip are interlocked in the block tie slots; placing another pair of block tie disposed on the further portion from the retainer tie wall of the previous block tie oriented in the same way as the previous block tie and continuing the replacing the wall tie, placing a pair of wall tie, placing another pair of block tie, and continuing steps until the desired height of the stairs is reached.

* * * * *